US008990970B2

(12) United States Patent
Lee

(10) Patent No.: US 8,990,970 B2
(45) Date of Patent: Mar. 31, 2015

(54) WIDE WAISTBAND AND PANT SUPPORTING UNDERGARMENT

(71) Applicant: Linda Lee, Laurel, MD (US)

(72) Inventor: Linda Lee, Laurel, MD (US)

( * ) Notice: Subject to any disclaimer, the term of this patent is extended or adjusted under 35 U.S.C. 154(b) by 0 days.

(21) Appl. No.: 14/147,751

(22) Filed: Jan. 6, 2014

(65) Prior Publication Data

US 2014/0196196 A1 Jul. 17, 2014

Related U.S. Application Data

(60) Provisional application No. 61/751,618, filed on Jan. 11, 2013.

(51) Int. Cl.

| | |
|---|---|
| ***A41F 19/00*** | (2006.01) |
| ***A41B 9/14*** | (2006.01) |
| ***A41F 7/00*** | (2006.01) |
| ***A41B 9/02*** | (2006.01) |

(52) U.S. Cl.

CPC ... *A41B 9/14* (2013.01); *A41F 7/00* (2013.01); *A41B 9/02* (2013.01)

USPC ..... 2/307

(58) Field of Classification Search

USPC ..... 2/227, 228, 236, 238, 307, 242, 22, 23, 2/70, 112, 229, 230, 315, 401

See application file for complete search history.

(56) References Cited

U.S. PATENT DOCUMENTS

| | | | | |
|---|---|---|---|---|
| 2,034,312 | A * | 3/1936 | Rubin | 2/228 |
| 5,093,935 | A | 3/1992 | Countee, Jr. | |
| 5,172,430 | A | 12/1992 | Lerma-Solis | |
| 5,689,832 | A * | 11/1997 | Head | 2/227 |
| 6,202,220 | B1 * | 3/2001 | Rhoden | 2/236 |
| 6,308,338 | B1 * | 10/2001 | Caldwell | 2/312 |
| 6,922,849 | B1 * | 8/2005 | Fedrick | 2/227 |
| 7,124,448 | B2 * | 10/2006 | Davenport | 2/229 |
| 7,231,672 | B2 | 6/2007 | Thomas | |
| 8,813,266 | B1 * | 8/2014 | Green | 2/400 |
| 2004/0255367 | A1 | 12/2004 | Harris | |

* cited by examiner

*Primary Examiner* — Tejash Patel

(74) *Attorney, Agent, or Firm* — Daniel Boudwin; Global Intellectual Property Agency LLC

(57) ABSTRACT

The present invention provides underwear that are configured for use with pants that are worn below the waistline of a user. The underwear may comprise a wide waistband that is configured to cover from one-third to one-half the total length of the underwear, whereby the waistband occupies an area from just above to just below the waistline of a user. Alternatively, the underwear may comprise hooks that are adapted to hold and maintain a pair of pants at a fixed distance from the waistline, and pockets for holding a user's belongings. The underwear may be made of an elastic material, such as nylon, and may be decorated with a variety of aesthetic colors and designs to suit the tastes of a user.

11 Claims, 4 Drawing Sheets

WIDE WAISTBAND AND PANT SUPPORTING UNDERGARMENT

CROSS REFERENCE TO RELATED APPLICATION

Figure 1A:
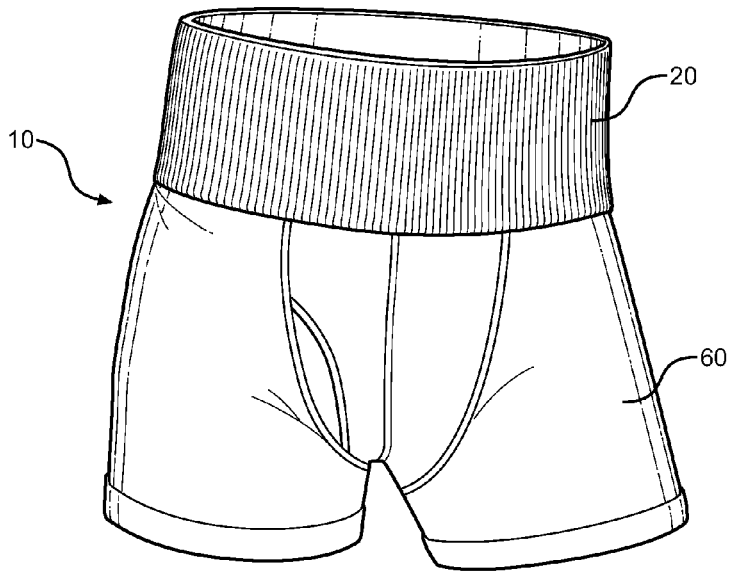

This application claims the benefit of U.S. Provisional Application No. 61/751,618 filed on Jan. 11, 2013. The above identified patent application is herein incorporated by reference in its entirety to provide continuity of disclosure.

BACKGROUND OF THE INVENTION

1. Field of the Invention

The present invention relates to an undergarment. More specifically the invention relates to underwear that are configured to resist falling down when the waistline of a user's pants are positioned below the waistline of a user.

Clothing styles may differ greatly between people in society. Sometimes the style difference is accomplished by wearing a common article of clothing in a different manner than others in the society. In many urban areas it has become common for the younger individuals to wear their pants a few sizes larger around the waistline when compared to how pants are traditionally worn. This may cause a user's pants to fall down when the user is walking or moving around.

The style of wearing a pair of pants below the waistline of a user is called sagging. This is accomplished by providing a pair of oversized pants that are too wide to be supported by the waist, but may still be supported over the buttocks of a user. The style, however, causes a user to constantly readjust their pants or forces them to walk awkwardly to prevent the pants from falling down. Moreover, the style of wearing the pants below the waistline may cause the underwear of a user to bunch up and stick out over the top of the waistline of the pants.

There are a variety of underwear that were developed to fix some of the drawbacks associated with the sagging of a user's pants. These devices typically provide pockets on the sides of the underwear. The pockets are convenient because they are easily accessible, while the pockets of pants that are positioned below the waistline may not be easily reached. While prior art devices are designed to provide accessibility and are useful in their own rights, they fail to address the need to prevent the underwear from bunching up and further fails to maintain the pants at a desired distance beneath the waistline.

The present invention provides a solution to the limitations of the underwear of the prior art. The underwear comprise a wide waistband that is configured to extend from just below the waistline of a user to an area just above the waistline. The waistband is made of a stretchable material, such as nylon. These materials assist in aiding the underwear to hug around the waist of a user, thus reducing the likelihood that the underwear would bunch up over the sagging pants. The underwear may further comprise hooks configured for attaching onto the belt loops of a pair of pants. The present invention is configured to enable a person to comfortably wear a pair of pants below the waistline without worry of having the pants fall down or having underwear bunch up.

2. Description of the Prior Art

Devices have been disclosed in the prior art that relate to modified underwear. These include devices that have been patented and published in patent application publications. These devices generally relate to underwear that comprise pockets configured for the storage of items. The following is a list of devices deemed most relevant to the present disclosure, which are herein described for the purposes of highlighting and differentiating the unique aspects of the present invention, and further highlighting the drawbacks existing in the prior art.

One such device in the prior art, U.S. Pat. No. 5,093,935 to Countee, Jr. provides an undergarment in the form of underwear. The underwear include a centrally-located pocket for the storage of small items. While the prior art device is useful for its own purposes, it fails to provide a wide waistband that is configured occupy a large area of the underwear.

Another prior art device, U.S. Pat. No. 6,172,430 to Lerma-Solis provides an undergarment that includes a torso surrounding web formed with an elastomeric waistband. A pocket is mounted onto the torso-web, whereby the pocket includes a zipper seam for securely closing the pocket opening. The device, however, fails to provide hooks adapted for supporting a pair of pants at a fixed distance from the waist of a user.

Yet another prior art device, U.S. Pat. No. 7,231,672 to Thomas provides an undergarment that includes a concealed inside pocket for holding items such a credit cards, keys, and money. The undergarment may further comprise a zipper closure. While the device of the prior art addresses the need for a pocket on an undergarment, it fails to further provide a large waistband that is configured providing support for a pair of pants.

Finally, U.S. Patent Publication No. 2004/0255367 to Harris teaches underwear that comprise hidden pockets on the interior of the underwear. The pocket may be placed on the interior of men's and women's underwear, including that of boxers, briefs, thongs, bras and swim suits. Although similar in nature and relevant to the present invention, the prior art fails to provide hooks that are configured to attach onto the belt loops of a pair of pants.

The present invention provides an undergarment in the form of underwear that are configured for use with pants that lie below the waistline. The underwear may comprise several mechanisms that provide a comfortable fitting when worn with sagging pants. The underwear may include a wide waistband that is configured to cover from just above and below a user's hips. The waistband may be comprised of an elastic material that hugs and secures around the hips. Moreover, the waistband may comprise cutouts to aid in securing the garment around the body, and a pair of arms that terminate in hooks for holding up a pair of pants.

In view of the drawbacks of the prior art devices, it is shown that the prior art has several known setbacks and that the present invention is substantially divergent in design elements from the prior art and subsequently it is clear that there is a need in the art for an improvement to existing undergarments. In this regard the instant invention substantially fulfills these needs.

SUMMARY OF THE INVENTION

In view of the foregoing disadvantages inherent in the known types of underwear now present in the prior art, the present invention provides a new undergarment wherein the same can be utilized for providing convenience for the user when wearing underwear with sagging pants is desired.

It is therefore an object of the present invention to provide a new and improved undergarment in the form of underwear, that has all of the advantages of the prior art and none of the disadvantages.

It is another object of the present invention to provide underwear that includes a wide waistband that is configured to cover an area above and below the hips, whereby the waistband occupies one-third to one-half of the total underwear length.

Another object of the present invention is to provide underwear having cutouts, whereby the cutouts may be covered with a mesh.

Yet another object of the present invention is to provide a waistband comprising a pair of arms that extend and terminate in hooks.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 1B:
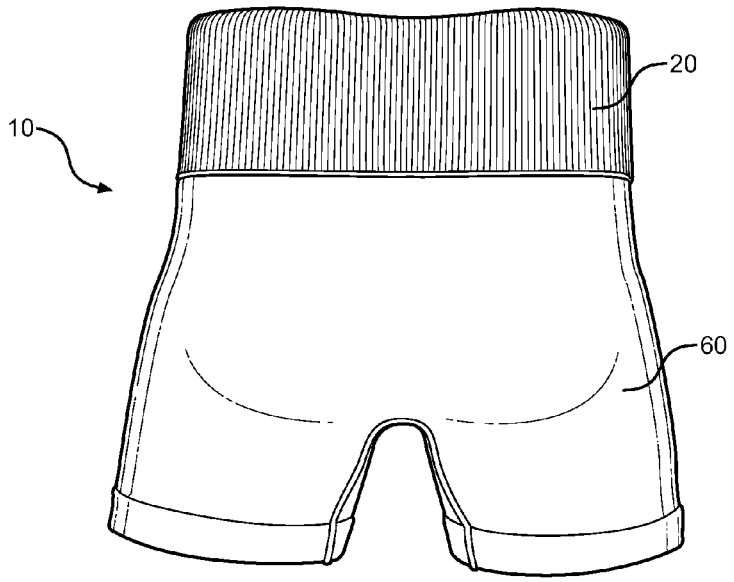

FIGS. 1A and 1B display front and rear views of the underwear of the present invention, whereby the underwear comprises a wide waistband.

Figure 2A:
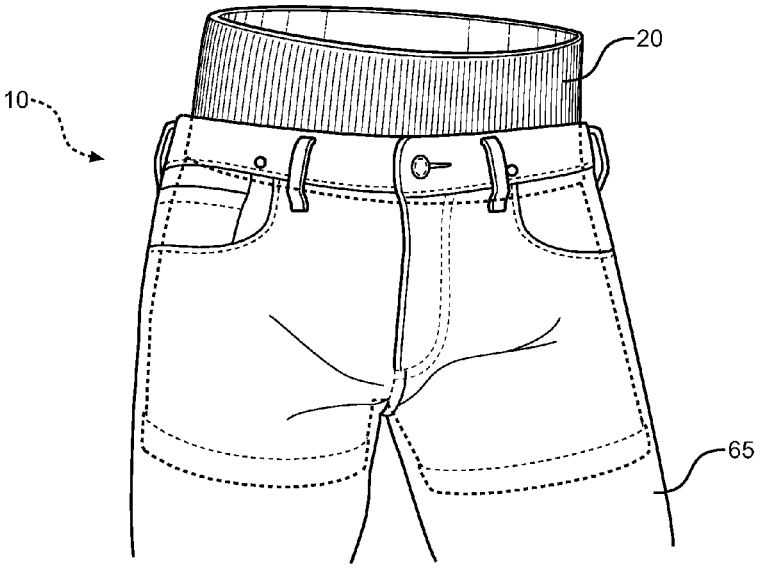
Figure 2B:
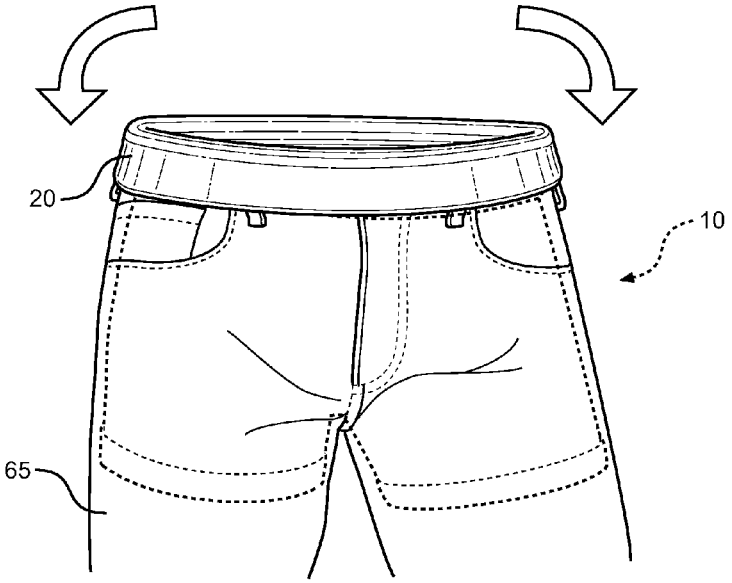

FIGS. 2A and 2B display views of the underwear of the present invention, whereby the underwear is capable of folding over the waistband of a pair of pants.

Figure 3A:
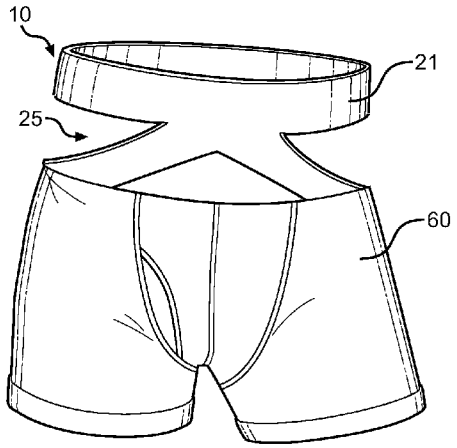
Figure 3B:
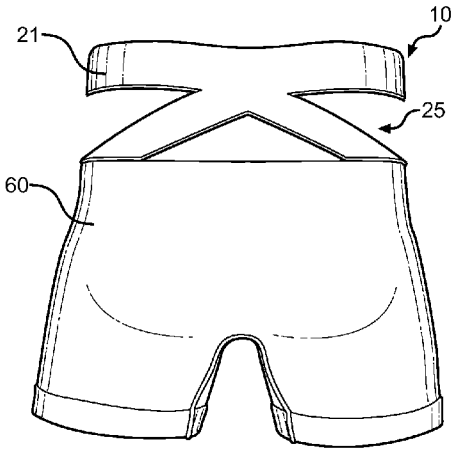

FIGS. 3A and 3B display front and rear views of the underwear of the present invention, whereby the underwear comprises cutouts within the waistband.

Figure 4A:
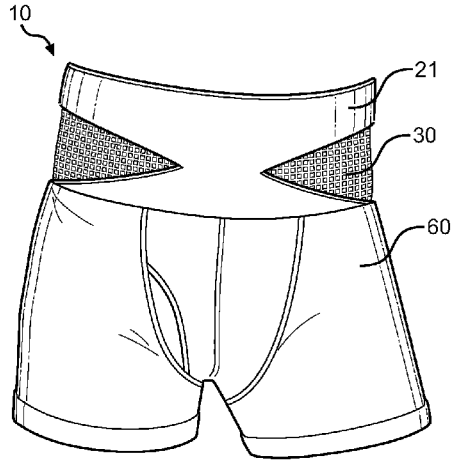
Figure 4B:
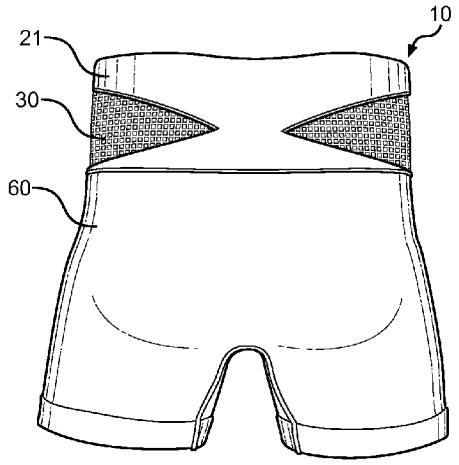

FIGS. 4A and 4B display front and rear views of the underwear of the present invention, whereby the waistband comprises a mesh netting.

Figures 5A, 5B:
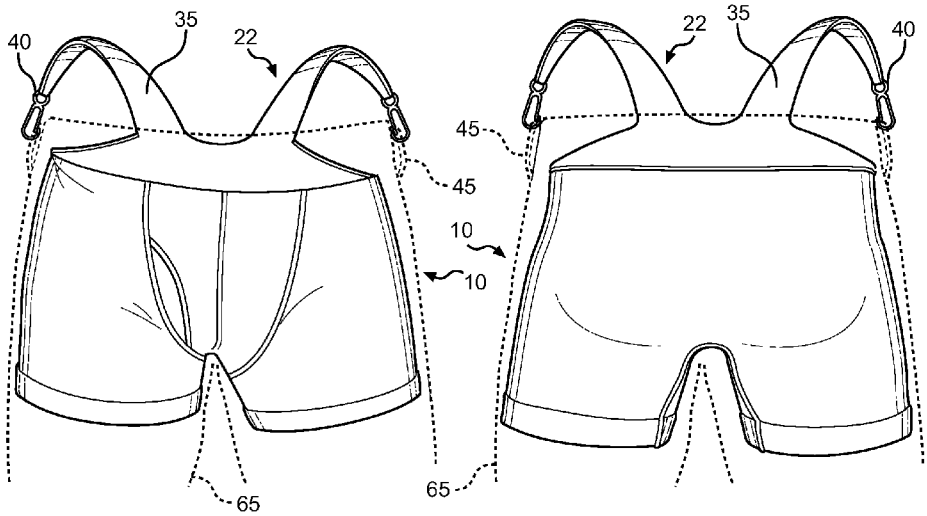

FIGS. 5A and 5B display front and rear views of the underwear of the present invention, whereby the waistband comprises clasps.

Figure 6:
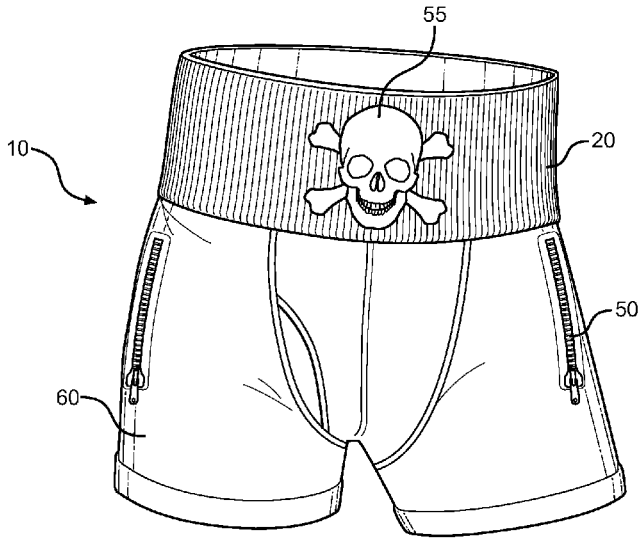

FIG. 6, displays a view of the underwear of the present invention, whereby the underwear comprises pockets.

DETAILED DESCRIPTION OF THE INVENTION

Reference is made herein to the attached drawings. Like reference numerals are used throughout the drawings to depict like or similar elements of the undergarment. For the purposes of presenting a brief and clear description of the present invention, the preferred embodiment will be discussed as used for keeping an undergarment in place while a user has sagging pants. The figures are intended for representative purposes only and should not be considered to be limiting in any respect.

Referring now to FIGS. 1A and 1B, there are shown frontal and rear views of the underwear 10 of the present invention, whereby the underwear 10 may be in the style of boxer shorts, however they may comprise briefs or bikini style underwear. The underwear 10 comprise a wide waistband 20 and an underwear body 60, whereby the waistband 20 is located on an upper portion of the underwear body 60. The waistband 20 is configured to occupy from one-third to one-half the total length of the underwear 10, thereby offering maximum support and comfort. The waistband 20 may be made of an elastic material such as nylon, or other suitable material that stretches and hugs onto the sides of a user's hips.

During use, the waistband 20 is configured to cover an area from just below the hips to just above the user's hips. The width and location of the waistband 20 along a user's body prevents the underwear 10 from bunching up or falling down when a user sags their pants. This is accomplished by the elastic waistband 20 being secured around the waist of the user. Moreover, the waistband 20 may comprise a textured material that may assist in holding up a pair of pants on the body.

Referring to FIGS. 2A and 2B, there are displayed views of the underwear of the present invention used with a pair of pants. The underwear 10 are incorporated with an upper elastic waistband 20 that is configured to remain in place when a user sags their pants. The wide waistband 20 may cover a large portion of the underwear 10, and comprises a length that is capable of being folded over the top of a user's pants. The waistband enables a user to wear their underwear 10 in a variety of orientations. A user may roll up the waistband 20 to add tension, wear the waistband 20 in a standard position, or fold the waistband 20 over the waistline of a pair of pants. All of the waistband 20 orientations provide differing support of the pants 65. As displayed in FIG. 2B, the length of the waistband 20 is capable of folding over the top of pants 65. This degree of folding determines the amount of sagging that is permitted, thereby providing a controlled sagging of pants. Additionally, the texture of the waistband 20 assists in holding the pants in position when the waistband 20 is folded over.

Referring now to FIGS. 3A and 3B, there are displayed front and rear alternative embodiments of the present invention, whereby the waistband 21 of the underwear 10 comprises cutouts. The cutouts 25 may be provided in order to improve maneuverability of the waistband. A user may grab the openings formed by the cutouts and position the waistband on a desired position on the user's hips. Thereafter the elasticity of the waistband 21 causes the underwear 10 to hug around the user's waist. These cutouts 25 may located on the front, back, or sides of the waistband 21 of the underwear 10. The cutouts 25 form openings along the underwear that provide additional gripping locations along the body. Furthermore, the cutouts 25 may also be positioned on the body 60 of the undergarment to provide additional securing features on the underwear 10.

Referring now to FIG. 4, there is displayed another alternative embodiment of the present invention, whereby the underwear 10 comprises mesh netting 30 within the cutouts. The mesh netting 30 is configured to retain the gripping properties of the cutouts (see 25, FIG. 3), while also promoting airflow to the hips. Additionally, the mesh material 30 may comprise moisture wicking properties. The mesh material may draw sweat and perspiration away from the body of the user, thereby cooling a user during warm weather.

When a user wears their pants below their waistline, their pants might fall down. FIG. 5 displays front and rear views of an alternative embodiment that comprises a waistband 22 having a pair of hooks 40. The waistband 22 is configured to offer support to a pair of pants 65. The waistband 22 comprises a pair of arms 35 that extend from above the body of the underwear 10. The arms 35 bend over the body of the underwear 10 and terminate in a distal hook 40. The hook 40 is configured to secure around the belt loops 45 of a pair of pants 65. In use, the elasticity of the underwear secures the underwear against the waist of a user. The arms 35 of the waistband 22 are pulled downward and the terminating hooks 40 are hooked onto a belt loop 45 on either side of the waistline of a pair of pants 65. The alternative embodiment mimics the functionality of a pair of suspenders by maintaining the pants at a first distance below the waist. Additionally, the hooks enable a user to comfortably wear their pants below the waistline without requiring a user to constantly adjust the pants or walk awkwardly to maintain their pants on their body.

Referring now to FIG. 6, there is shown an embodiment of the present invention, whereby the sides of the underwear 10 comprise pockets 50 and decorative features 55. The pockets 50 may comprise a closure means such as zipper, hook and loop, and snap fasteners. When a user sags their pants, the pockets of the pants may reside too far below their waist to be easily accessed. The pockets 50 of the present invention may be located on the sides of the underwear 10, thereby providing convenient accessibility to the hands of a user. They may comprise small or larger interiors that are capable of holding items such as a wallet, keys, cellular phone, etc. The underwear may further comprise decorative illustrations 55 that increase the aesthetic value of the underwear 10. The illustrations 55 may be located on the waistband 20 or on the body 60 of the underwear 10. Moreover, the under may comprise a variety of different colors or attachments to suit the needs of a user.

The present invention provides an undergarment that is configured for use with pants that are worn below the waistline. The underwear comprises a wide waistband 20 that is made of an elastic material, such as nylon. The waistband 20 extends from just below the waistline to just above the waistline of a user, whereby the waistband 20 occupies one-third to one-half the length of the underwear 10. The material, and the length of the underwear facilitates the hugging of the clothing against the sides of the user's waist. Optionally, the underwear may comprise cutouts 25 that form openings in the underwear. These cutouts may be located on the waistband 20 or on the body 60 of the underwear 10. The cutouts 25 provide additional areas that facilitate the securement of the undergarment against the body of the user. Additionally, the cutouts may comprise a mesh interior 30 that is configured for promoting airflow and wicking sweat away from the body.

The waistband may be further modified by providing a pair of arms 35 that extend from the waistband 22 (see FIG. 5). The arms 35 terminate in a pair of hooks 40 that are adapted for hooking onto the belt loops 45 of a pair of pants 65. The arms 35 fold downward from the waistline area of a user, and hook 40 onto the belt loops 45 of sagging pants. The sagging pants 65 are held at a fixed distance below the waistband of the underwear 10, thereby preventing the pants from falling or sagging further down the body of the wearer. The underwear 10 may also comprise pockets 50 for holding the belongings of a user, which is convenient when the pockets of a pair of sagging pants are out of reach. It is contemplated that the present invention may comprise any combination of the alternative embodiments. For example, the underwear may comprise a wide waistband, arms having hooks, and pockets. Or alternatively, the underwear may comprise a wide waistband, mesh cutouts, and pockets. Moreover, the underwear of the present invention may comprise a variety of aesthetic colors and designs, which may be placed on the waistband or on the body of the underwear.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An undergarment configured for use with pants that rest below the waistline of a user, the undergarment comprising;
underwear having a waistband and an underwear body;
whereby said waistband comprises a length in the range of about one-third to one-half of the overall length of said underwear body;
and whereby said waistband is comprised of an elastic material that is configured to compress against the waist of a user;
wherein said waistband comprises a high friction surface for supporting a pair of pants when said waistband is folded over an upper portion of said pair of pants.

2. The undergarment of claim 1, wherein said waistband further comprises cutouts, whereby said cutouts are adapted to increase maneuverability of said waistband.

3. The undergarment of claim 1, wherein said waistband comprises cutouts, whereby said cutouts are covered by a mesh that is configured to promote airflow.

4. The undergarment of claim 1, wherein said waistband further comprises a pair of arms that are configured for connecting to a pair of pants, whereby each of said pair of arms terminates in a hook that is adapted for insertion into the belt loop of said pair of pants.

5. The undergarment of claim 1, wherein said underwear body comprises a reclosable pocket.

6. The undergarment of claim 1, wherein said waistband comprises a textured material that is configured for supporting a pair of pants.

7. An undergarment configured for use with pants that rest below the waistline of a user, the undergarment comprising;
underwear having a waistband and an underwear body;
said waistband further comprises a pair of arms that are configured for connecting to a pair of pants, whereby each of said pair of arms terminates in a hook that is adapted for insertion into the belt loop of said pair of pants.

8. The undergarment of claim 7, wherein said underwear body comprises a reclosable pocket.

9. An undergarment configured for use with pants that rest below the waistline of a user, the undergarment comprising;
underwear having an elastic waistband and an underwear body;
said waistband comprising a length in the range of about one-third to one-half of the overall length of said underwear body;
said waistband comprising cutouts, whereby said cutouts are covered by a mesh that is configured to promote airflow.

10. The undergarment of claim 9, wherein said waistband further comprises a pair of arms that are configured for connecting to a pair of pants, whereby each arm terminates in a hook that is adapted for insertion into the belt loop of said pair of pants.

11. The undergarment of claim 9, wherein said underwear body comprises a reclosable pocket.

* * * * *